US005421587A

United States Patent [19]

Mao-Huang

[11] Patent Number: 5,421,587

[45] Date of Patent: Jun. 6, 1995

[54] SHUTTLECOCK

[75] Inventor: Liu Mao-Huang, Taipei, Taiwan, Prov. of China

[73] Assignee: Key Luck Industrial Corporation, Taipei, Taiwan, Prov. of China

[21] Appl. No.: 328,013

[22] Filed: Oct. 24, 1994

[51] Int. Cl.[6] ..... A63B 67/18

[52] U.S. Cl. ..... 273/417

[58] Field of Search ..... 273/417

[56] References Cited

U.S. PATENT DOCUMENTS

| | | | |
|---|---|---|---|
| 3,560,128 | 2/1971 | Carlton | 273/417 |
| 3,831,943 | 8/1974 | Popplewell | 273/417 |
| 4,305,589 | 12/1981 | Popplewell | 273/417 |
| 4,509,761 | 4/1985 | Liu | 273/417 |
| 4,538,818 | 9/1985 | Sinclair | 273/417 |

FOREIGN PATENT DOCUMENTS

| | | | |
|---|---|---|---|
| 996695 | 6/1965 | United Kingdom | 273/417 |
| 1103364 | 2/1968 | United Kingdom | 273/417 |
| 1542497 | 3/1979 | United Kingdom | 273/417 |

*Primary Examiner*—Paul E. Shapiro

*Attorney, Agent, or Firm*—Browdy and Neimark

[57] ABSTRACT

An improved shuttlecock for use in a badminton game is provided with a cork cap and a cone-shaped skirt which is provided with a plurality of evenly spaced stems. The stems diverges from a top end having a collar tube having more than one securing flange for securedly mounting the goal cap. A pair of integrally formed reinforcement hoops secure the stems together with a plurality of circular rings of different sizes parallelly extending downwardly from the lowerest hoop to the bottom of the skirt. A feather-like wing portion divided by a stem into left and right wing portions has a triangular wing tail. A partition area is disposed between two of the wing portions. Each left wing portion has a plurality of parallel slanted strands extending in an angle from each stem from right to left and right wing portion also has a plurality of parallel slanted strands extending in an angle from left to right from each stem. A plurality of holes form in the left wing portion and the right wing portion with the density of the former larger than the latter. The ration of the horizontal width of the left wing portion to the right wing portion is approximately 2:1.

4 Claims, 3 Drawing Sheets

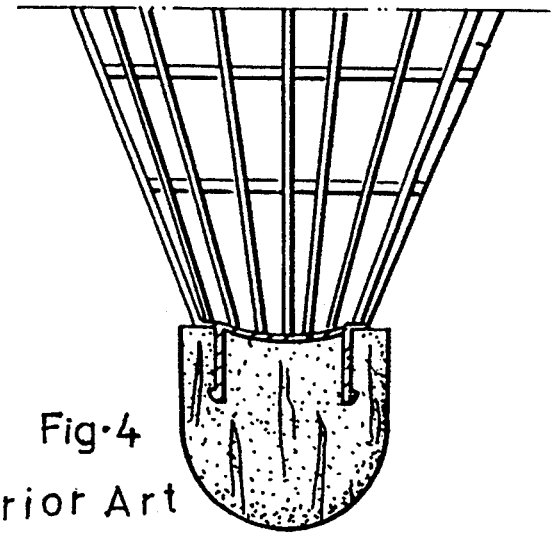
Fig·4
Prior Art
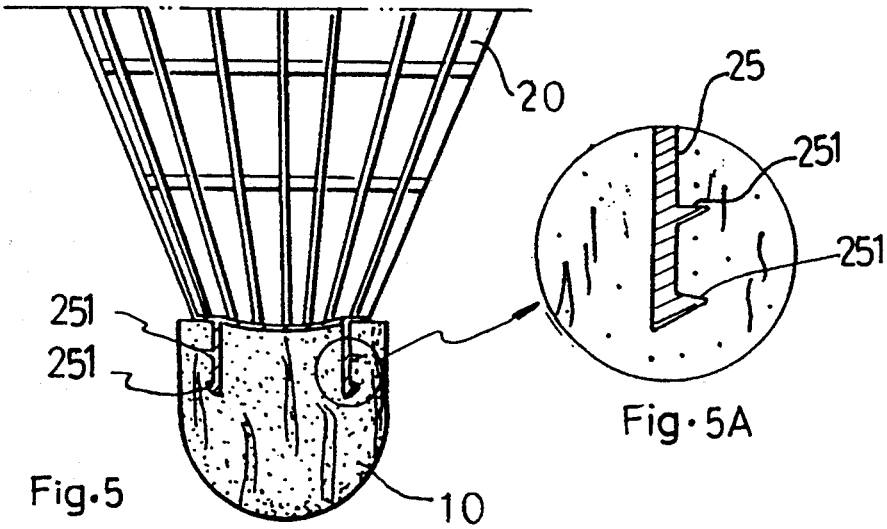
Fig·5A
Fig·5

SHUTTLECOCK

BACKGROUND OF THE INVENTION

The present invention relates to an improved plastic shuttlecock for use in a badminton game.

In general, a conventional shuttlcock is made up of a plurality of natural feathers which are bound together piece by piece by adhesive glue and threads. It takes a lot of labor and time to produce a shuttlecock of good quality for use in a formal game. First, feathers meeting certain standards must be sorted out by way of manual labor and then are pieced together by adhesive glue and threads into a cone shape; at the end, a cork cap is attached to the topmost end thereof. Such a natural shuttlecock is easily damaged when it is hit not on the cork cap but on flight feathers with force.

It is relatively expensive to produce such a natural shuttlecock because of involvement of too much manual labor and time.

To make a shuttlecock more durable, plastic shuttlecocks have been designed and developed for many years. Over those years, some kinds of high quality plastic shuttlecocks having good controllability, flying stability and satisfactory feeling of stroke are available in sporting markets.

It seems an increasing trend for badminton players to substitute feather shuttlecocks with plastic ones in routine practices. However, there are still some problems associated with such a prior art plastic shuttlecock in design, which make a conventional plastic shuttlecock unable to perfectly conform to aerodynamic requirements given as below:

1. At the end of each flight journey i.e., as horizontal speed becomes zero, a shuttlecock must be dropped as vertically as possible.
2. A shuttlecock itself must not swing to and fro in flight.
3. The flight direction must conform to the hitting direction.

As shown in FIG. 1, a conventional plastic shuttlecock has offered the design of lower skirt undulation which had two different ratios of surfaces formed by the undulation with the surfaces trellised in different densities so as to offer the effect of rotation during the flight. The design of tail skirt undulation has been prevailing among the plastic shuttlecocks giving them increasing flight stablility, and also offering the necessary means for preventing them from swinging to and fro during flight. However, the lower skirt of a plastic moulded shuttlecock, which is handicapped by the weight distribution and the tail skirt undulation being supported by the very thin stems, used to be deformed and shrunk by air pressure when it was hit by a racket. Then, the projection area of the lower skirt was decreased, and the radius of counter-rotation (owing to the air resistant area being decreased) was increased. Thus, the problems of accuracy of stroke, stability of counter-stroke and control should be improved accordingly. Furthermore, the design of the air resistant area of the lower skirt undulation have not permitted improvement of the exhaust air stream by opening larger air stream outlets therein owing to its weak structure. However, the difference of air sucking pressure between inner and outer sides of the lower skirt can not be lowered, thus improved flight stability of a shuttlecock can not be obtained.

Furthermore, the collar tube of a cork cap of a prior art plastic shuttlecock has the following disadvantages:

1. The structural strength of a prior art collar tube is not satisfactory.
2. A shuttlecock will be seriously deformed at the corrugated tail portion into an elliptic form as a result of minor improper fitting of the cork cap to a collar tube.
3. A cork cap will be easily separated from the collar tube after a certain number of hittings because of the securing flanges on a collar tube can not hold a cork cap firmly in place, resulting in shortening of operation time of a shuttlecock.
4. The improvement of the strength of a collar tube by increasing the wall thickness thereof results in an increase of weight at the front end of a shuttlecock, reducing the flying speed thereof.
5. When adhesive glue is evenly dispensed all over a collar tube and the securing flanges, fixing of a cork cap onto the collar tube will easily push the adhesive glue to one end of the cap, making the other part of the cap lack of adhesive glue. That causes a cork cap to be easily separated from a shuttlecock when hit a certain number of times.
6. Lack of strength of a collar tube generally results in deformation at the corrugated skirt of a shuttlecock when a cork cap is forced into engagement therewith, seriously effecting the flying features of a shuttlecock.

SUMMARY OF THE INVENTION

Therefore, the primary object of the present invention is to provide a plastic shuttlecock used in a badminton game which has an improved skirt having particular trellis pattern and corrugated tail portion on each feather-like units so as to strengthen the skirt portion of a shuttlecock and to provide proper air expeling ability, preventing the skirt of a hit-back shuttlecock from excessive deformation and air catching area thereof being reduced whereby the precision of hitting and feeling of control of a shuttlecock are greatly improved; furthermore, the efficiency of rotation and the diameter of flying orbit is reduced and the flying stability of the shuttlecock is also advanced.

Another object of the present invention is to provide an improved plastic shuttlecock which has a collar tube on which more than one securing flanges are provided so as to build up the strength thereof without putting too much extra weight thereto.

One further object of the present invention is to provide an improved plastic shuttlecock which has a collar tube having more than one securing flanges dipsosed thereon so as to permit more adhesive glue to be effectively distributed and retained in place whereby a cork cap can be securedly engaged with a collar tube of a shuttlecock, prolonging the operation life of a shuttlecock accordingly.

BRIEF DESCRIPTION OF THE DRAWINGS

FIG. 4 is a sectional diagram showing the securing flange and a cork cap of a prior art;

FIG. 5 is a sectional diagram showing the securing flange of the present invention;

FIG. 5A is an enlarged diagram showing the securing flange of a collar tube of the present invention.

DETAILED DESCRIPTION OF THE PREFERRED EMBODIMENT

Figure 1:
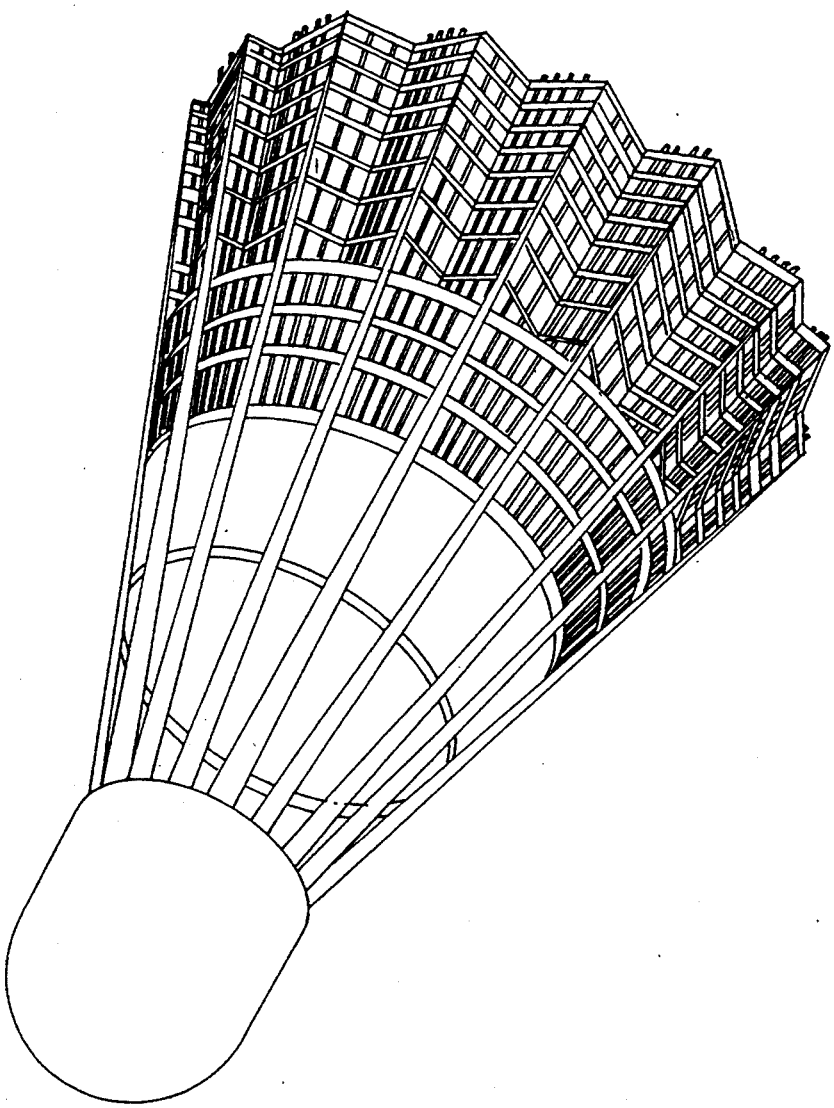
Fig. 1 Prior Art
FIG. 1 is a diagram showing a conventional plastic shuttlecock.
Figure 2:
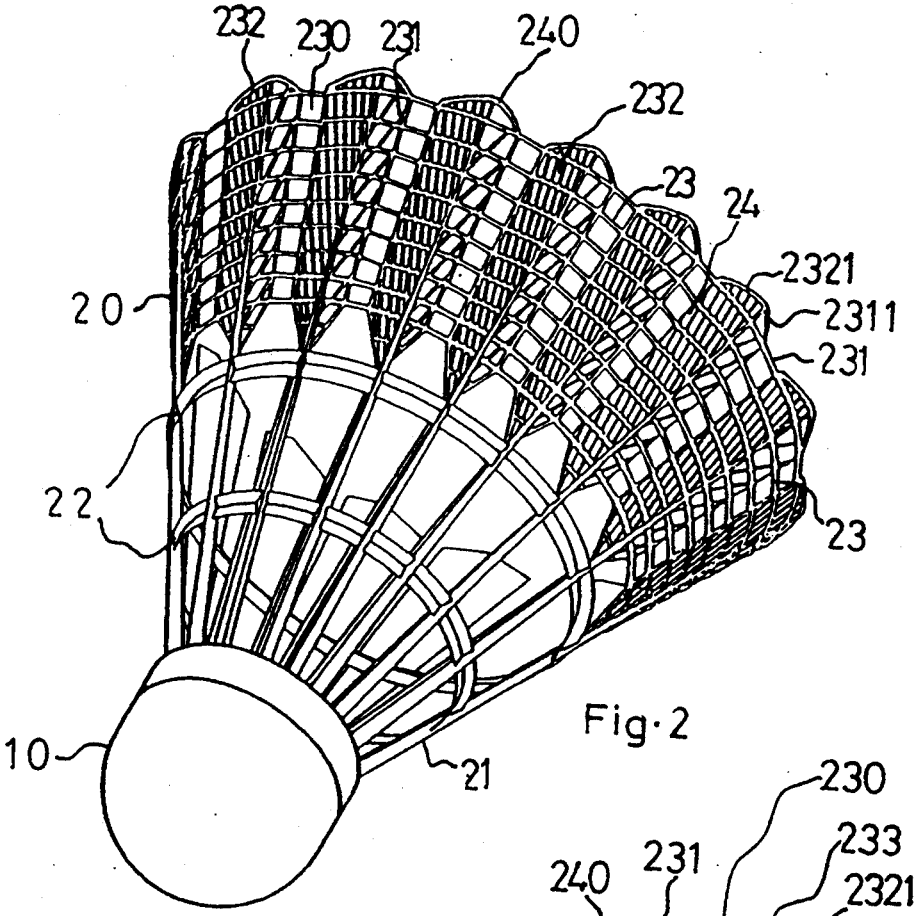
FIG. 2 is a perspective diagram showing a plastic shuttlecock of the present invention.

Referring to FIG. 2, a shuttlecock of the present invention mainly has a cork cap 10 and a shuttlecock skirt 20. The cork cap 10 is usually made of cork or multi-porous platic material; and the shuttlecock skirt 20 is integrally made of Nylon or Polyethylene by injection molding and is mainly comprised of a plurality of stems 21 and a pair of reinforcement hoops 22, and a plurality of surrounding rings 23 and wing portions 24.

As shown in FIG. 2, a perspective diagram illustrates a shuttlecock of the present invention. The shuttlecock skirt 20 and the cork cap 10 are combined to form a shuttlecock of the present invention. The stems 21 converge at one end to form a retaining collar 25 with the cork cap 10 secured thereto, the other end of the stems 21 expands outwardly to form a cone-shaped structure.

The stems 21 becomes gradually reduced in size from the cork cap end to the rim of a triangular wing tail 240 of the skirt 20. The skirt 20 has a pair of or more circular reinforcement hoops 22 disposed consecutively adjacent to the cork cap 10 to build up the strength of a shuttlecock. From the lowerst circular reinforcement hoop 22 extend downwardly a plurality of identical wing portions 24 each of which is integrally associated with a stem 21. A plurality of spaced parallel circular rings 23 extend downwardly from the lowerest reinforcement hoop 22 to the peripheral rim of the skirt 20 that are used to build up the strength of a shuttlecock so as to prevent a shuttlecock in flight from deformation of its skirt 20 due to large air pressure.

The bottom rim of the skirt 20, extending from the wing portions 24, has a plurality of triangular wing tails 240.

Figure 3:
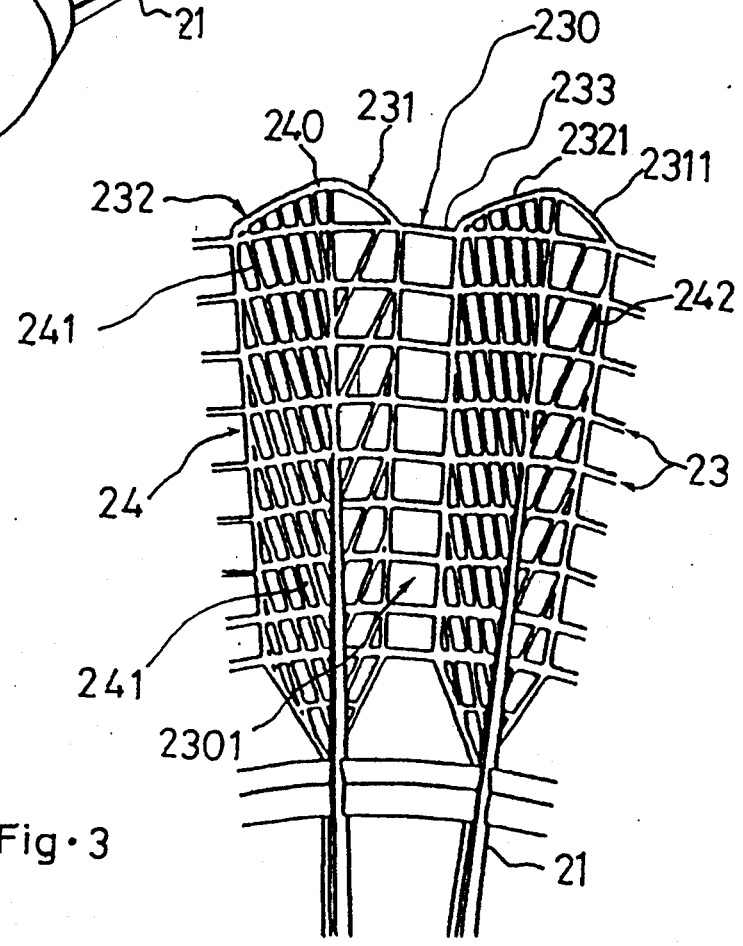
FIG. 3 is a diagram showing a detailed structure of a shuttlecock of the present invention.

Referring to FIG. 3, a detailed structure of a portion of two wing portions 24 is clearly shown. The wing portion 24 is a wing catching surface and is divided by an extended stem 21 into a left wing portion 232 and a right wing portion 231 having different wind catching abilities. Each left wing portion 232 has a plurality of parallel slanted strands 241 each of which extends along a stem 21 from right to left in a slanted angle to one side of the corresponding triangular wing tail 240 so as to increase the rotation effect and the flying stability thereof and to reduce the wind barrier in hitting back a shuttle and the turning-head diameter, improving the sensitivity and controllability of a shuttlecock.

The right wing portion 231 has a number of parallel strands 242 slantly extending from a stem 21 from left to right so as to conform to the tangent force of a head-on wind, making the shuttlecock to spin in a smoother manner, and to drop nearly vertically at the end of a flying orbit when the horizontal speed is zero.

A wind expelling partition area 230 is formed between two wing portions 24 and the triangular wing tail 240 is divided by a stem 21 in such a manner that the left side 2321 of the left wing portion 232 has a length equal to the length of the right side 2311 of the right wing portion 231 plus the edge 233 of the partition area 230; and the ratio of the width of the left wing portion 232 to the width of the right wing portion 231 is approximately 2:1.

Each partition area 230 is divided by a plurality of parallel circular rings 23 and two wing portions 24 into a number of square holes 2301 so as to form a good air expelling face, and the left wing portion 232 and the right wing portion 231 having more smaller holes formed therein, creating an ideal wind catching face making a shuttlecock to spin in a more smooth manner and fly in a more stable manner.

Referring to FIG. 5, 5A, a collar tube 25 extending from the skirt 20 of a shuttlecock is engaged with a goal cap 10 by adhesive glue. The collar tube 25 is provided with a hooked engagement flange 251 at the front tip thereof and an extra hooked flange 251 is spaced apart therefrom whereby adhesive glue can be more evenly distributed in between the hooked flanges 251 so as to effectively retain a cork cap 10 in place, preventing the cork cap 10 from disengagement from the collar tube even under repeated heavy hits back and forth. Thus, the operation life of a shuttlecock can be effectively prolonged Furthermore, the collar tube 25 provided with more than one hooked flanges 251 is reinforced in strength so as to effectively prevent a skirt 20 from easy deformation under hitting. The addition of an extra flange 251 results in reinforcement of a shuttlecock but in increase of little weight, and a proper selection of a cork cap can still make such a shuttlecock fly in a stable manner and the flying orbit in a projectile.

I claim:

1. An improved plastic shuttlecock for use in a badminton game, comprising:

a cork cap made of cork or multi-porous plastics;

a cone-shaped skirt having the topmost end terminating in a collar tube;

said cork cap being mounted onto said collar tube;

said skirt further comprising:

a plurality of stems divergely extending downwardly from said collar tube and evenly spaced from one another;

a pair of differently sized reinforcement hoops spaced parallelly from each other and surrounding all said stems;

said stems extending from said collar tube downwardly with the cross section thereof becoming gradually reduced;

a plurality of parallel circular rings having different diameters extending downwardly from the lowerest reinforcement hoop to the bottom of said skirt;

a wing portion being engaged with each stem extending from said lowerest reinforcement hoop to the bottom of said skirt having a right wing portion and a left wing portion divided by said stem, and terminating in a triangular wing tail;

a partition area disposed between two said wing portions being divided by said circular rings and edges of said wing portions into rectangular holes;

said left portion having a plurality of slanted parallel strands slantly extending in an angle from said stem to an edge of said left wing portion and intersecting with parallel circular rings to form a plurality of holes;

said right wing portion having a plurality of slanted parallel strands slantly extending in an angle from said stem to an edge of said right wing portion and intersecting with parallel circular rings to form a plurality of holes which are larger than those in said left wing portion.

2. An improved plastic shuttlecock as claimed in claim 1 wherein the length of the side of said triangular wing tail of said left wing portion is approximately equal to the sum of the length of the side of said triangular wing tail of said right wing portion and the width of an edge of said partition area between said wing portions.

3. An improved plastic shuttlecock as claimed in claim 1 wherein the ratio of the horizontal width of said left wing portion to that of said right wing portion is approximately 2:1.

4. An improved plastic shuttlecock as claimed in claim 1 wherein said collar tube has more than one engagement ring flanges, permitting said goal cap to be more securedly engaged with said collar tube by adhesive glue.

* * * * *